US006742295B2

(12) United States Patent
Gross

(10) Patent No.: US 6,742,295 B2
(45) Date of Patent: Jun. 1, 2004

(54) SYSTEM FOR SUSPENDING OR MOUNTING PRICELESS PLANAR ARTWORK AND THE LIKE

(76) Inventor: James R. Gross, 680 Creekside Cir., Gurnee, IL (US) 60031-2057

( * ) Notice: Subject to any disclaimer, the term of this patent is extended or adjusted under 35 U.S.C. 154(b) by 14 days.

(21) Appl. No.: 10/175,011

(22) Filed: Jun. 20, 2002

(65) Prior Publication Data

US 2003/0233778 A1 Dec. 25, 2003

(51) Int. Cl.[7] ..... A47G 1/06
(52) U.S. Cl. ..... 40/711; 40/777
(58) Field of Search ..... 40/124.04, 600, 40/661.01, 711, 768, 777, 781; 248/467

(56) References Cited

U.S. PATENT DOCUMENTS 2,259,272 A * 10/1941 Sholkin et al. ..... 40/611.05
2,557,399 A * 6/1951 Teetor ..... 40/124.04
3,124,501 A * 3/1964 Wise ..... 428/167
3,456,374 A * 7/1969 Baermann ..... 40/701
5,167,085 A * 12/1992 Yang ..... 40/711
5,502,907 A * 4/1996 Wang ..... 40/711
6,256,914 B1 * 7/2001 Yeh ..... 40/720

FOREIGN PATENT DOCUMENTS

GB 2263572 * 7/1993 ..... 40/600

* cited by examiner

*Primary Examiner*—Brian K. Green
(74) *Attorney, Agent, or Firm*—Alvin Isaacs

(57) ABSTRACT

Disclosed is a novel system for suspending artwork, photographs, documents and other planar material for display in which one edge (the top edge of the material) instead of being attached to hinges, is positioned between opposed magnetic materials having a strong reciprocal force tightly gripping the planar material therebetween whereby the planar article is releasably mounted for display. One of each set of opposed magnetic materials is seated within a recessed area of a mounting board providing a backing for the artwork or other planar article; while the other magnetic material is seated within a mat or other planar material designed to be positioned over the face of the artwork or other planar material to be displayed. It is particularly useful for mounting for display priceless artwork and archival documents which can suffer irreversible degradation from the hinging techniques heretofore employed for such priceless planar materials.

20 Claims, 5 Drawing Sheets

SYSTEM FOR SUSPENDING OR MOUNTING PRICELESS PLANAR ARTWORK AND THE LIKE

BACKGROUND OF THE INVENTION

This invention relates to a novel method for suspending or mounting planar artwork, photographs, documents and the like, and particularly such planar articles of priceless value and/or historical significance. Since the prime interest is thought to be in artwork, i.e. paintings, etchings, lithographs, etc. by well-renowned if not famous masters, for simplicity the present invention will be restricted thereto.

The suspension of artwork within a structure, e.g., a frame, has been practiced for centuries much in the same way as it today. This method, commonly known as the paper hinge method, is further described in the literature as a "conservative method" or art preserving method for suspending the artwork for display. These known methods are aptly described, for example, in "MATTING AND HINGING OF WORKS OF ART ON PAPER", a National Preservation Program Publication, Library of Congress (ISBN 0-8444-0386-5); "HOW TO CARE FOR WORKS OF ART ON PAPER", Museum of Fine Arts, Boston (ISBN 0-87846-254-6); "FRAMING AND CONSERVATION OF WORKS OF ART ON PAPER", by Douglas M. Kenyon, Conservator of Prints and drawings, The Art Institute of Chicago (1969–1978); and "INKSMITH ARTIST NEWS", vol. III, issue no. 2, November–December, 1986, Daniel Smith, Inc., among others.

All of the above publications describe the method known for centuries for mounting and suspending flat, fibrous works of art to mounting boards ("backboards") by means of paper hinges. Specifically, an object of art, e.g., an etching, lithograph or watercolor, selected for vertical display is mounted on a display system comprising a mounting board, frame, mat and a cover of clear glass or plastic.

The artwork is first positioned on the mounting board. Paper hinges are then prepared, the length, width, thickness and material of which are selected based on the size, weight and material of the artwork. Next a paste is prepared for attaching the hinge to the artwork and to the board. (This paste is typically made from wheat or rice.) Often a preservative or other reagent is added to prevent infestation or consumption by insects, fungus or other bacteria which consume wheat and rice based items. The paste is a food source for many organisms and accordingly invites infestation and consumption of not only the dried paste, but the artwork as well.

Once the paste has been properly prepared, one end section of each hinge is placed on the back top surface of the artwork. Paste is applied to the hinge where it contacts the artwork. The paste is allowed to dry until the moisture in the paste solution which has mingled with both the fibers of the hinge and the fibers of the artwork evaporates off, but not before the moisture has enlarged the fibers it has reached. Afterwards, the opposed end section of the hinge is pasted to the mounting board so that the artwork is now connected to and suspended from the mounting board and may now be framed.

The above mounting procedure is frequently referred to as the "conservative" manner of mounting artwork. It is called "conservative" because the hinge attachment may be reversed by applying water to activate the paste, thereby permitting removal from the artwork.

This system for mounting artwork for vertical displaying, known for centuries and still generally used today, suffers from several deficiencies or detriments to be described hereinafter.

The paste used to attach the artwork to the mounting board uses a water base which invades the fibers of both the hinge material and the artwork. During the papermaking process, the paper fibers are separated and mixed into a slurry of water. The fibers expand during this process and then interlink with one another. Next the slurry is caught on a screen where they intermingle and link together to form a blanket of fibers which are then transferred to a felt pad and a second felt pad is then placed thereover to sandwich the blanket of fibers therebetween. Pressure is applied to dry, flatten and lock the fibers together. The resulting sheet, called a "waterleaf" may then be sized by dipping it in a bath of gelatin or starch. This sizing limits the dispersion of water-based colorant into the sheet.

When moisture in the paste is introduced to the surface of the artwork, the fibers in the sheet reabsorb the moisture and swell. This swelling irreversibly moves the fibers apart as they absorb water, resulting in a less dense section of the sheet and therefore a change in its makeup or structure, e g., a softening or reduction in strength.

This condition is particularly to be avoided when the artwork is a masterpiece or a one-of-a-kind, priceless or very expensive piece, such as works of Rembrandt, Monet, Chagall, etc.

In addition to the physical change when moisture is introduced is the infusion of paste particles in the form of wheat or rice invading the interstices of the fibers. These particles from the glue bonding the hinge to the artwork bond to the fibers in a semi-permanent matrix. While this bond, as alluded to earlier, is reversible, it is still impossible to remove every paste particle. These residual paste particles are initially a foreign object within the fibers of the artwork and secondly are potentially a food source for infestation. The various forms of infestation can and do consume not only the paste but portions of the artwork itself.

A further detriment to the application of paste is the absorption by the paste of airborne contaminants which may be present in the ambient atmosphere during and subsequent to pasting.

The hinges themselves are also made from various papers and as such are subject to the same detrimental effects as the artwork. They are torn or cut from papers which resemble the density and fiber strength of the artwork. However, the hinges are not typically made from the same sheet material as the artwork and usually are not as old as the artwork so that the resulting connection or bonding of the hinge to the artwork is the "marrying of dissimilar" materials. This results in different rates and differences of the bonding of the paste to both the hinge and the artwork. It can therefore be concluded that the ultimate bond of hinge to both the artwork and the mounting board can never be measured or determined until the actual bond has been finalized. Afterward, the competence of the "expert" must be taken for granted.

The loss of a hinge could result in the artwork shifting or falling from the board, resulting in irreparable damage to the artwork itself.

One of the primary reasons for using paper for hinges is that the hinge will expand and contract at relatively the same rate as the artwork sheet itself This prevents binding of the artwork between the hinges which could result in stretching or tearing of the artwork between the hinges.

Unfortunately, it is extremely difficult to predetermine the various expansion and contraction rates of all the various hinge papers available to the technician.

Another type of hinge material in use today is the pre-gummed hinge tape. These tapes are of linen or paper construction with a pre-applied, water-activated adhesive layer. They are less capable of changing size when the artwork is subjected to expansion and contraction forces due to changes in the ambient temperature.

These tape hinges are also touted to be reversible with water, but the same limitations apply as with paper hinges and water.

Yet another method of mounting artwork and holding it to a mounting board for display purposes is the "Photomount" method. This consists of forming troughs or ledges which contain the artwork without physically adhering something to the artwork. This leaves the artwork to float within the ledges where it can contract and expand with ambient humidity changes. In this method, the artwork can sag within the mounting structure, resulting in wrinkles or waves which will become permanent for the artwork.

As will be appreciated, all of the methods described above and still in use today for hanging artwork for vertical display present one or more problems. These problems constitute the task of this invention, namely to find a means for mounting artwork for vertical display which presents none of these problems, permitting the artwork to remain without any chemical or physical changes.

BRIEF DESCRIPTION OF THE INVENTION

According to this invention, this task is solved in an elegant manner by devising a novel system for displaying artwork in a vertical manner, e.g. as in a frame mounted on a wall, the system including at least one magnet, preferably two or more magnets, each such magnet mating with another magnet of opposite polarity or a metallic element having a strong reciprocal magnetic attraction, e.g. a ferro-magnetic material, adapted for placement in superposition with each such magnet to provide a strong magnetic force of attraction firmly clamping to releasably secure an edge of the artwork when placed within the magnetic force; and means securing the magnets to a mounting board whereby the artwork is suspended from the mounting board by means of the clamping magnetic force.

A very important feature of the present invention, to be explained in detail hereinafter is that the magnets are seated in opposed recessed areas of the mounting board for the artwork or the like to be mounted and the mat overlay for the artwork. These recessed areas may be in the form of grooves, notches, slots and the like and in the case of the mounting board may even comprise holes adapted to receive the particular configuration of the magnets to be employed.

Since the invention will typically comprise two such magnetic mounting means, the invention will be discussed hereinafter and described in the illustrative drawings as showing only two magnetic mounting means. In the preferred embodiment, each magnetic mounting means will be provided by a pair of magnets of opposite polarity, the magnets generally being known as north or south magnets. Most preferably, for aesthetic purposes and ease of securing the magnets to the artwork, the magnets will be generally circular in configuration although other shapes such as bars and the like commercially available are also contemplated.

DETAILED DESCRIPTION OF THE INVENTION

Figure 1:
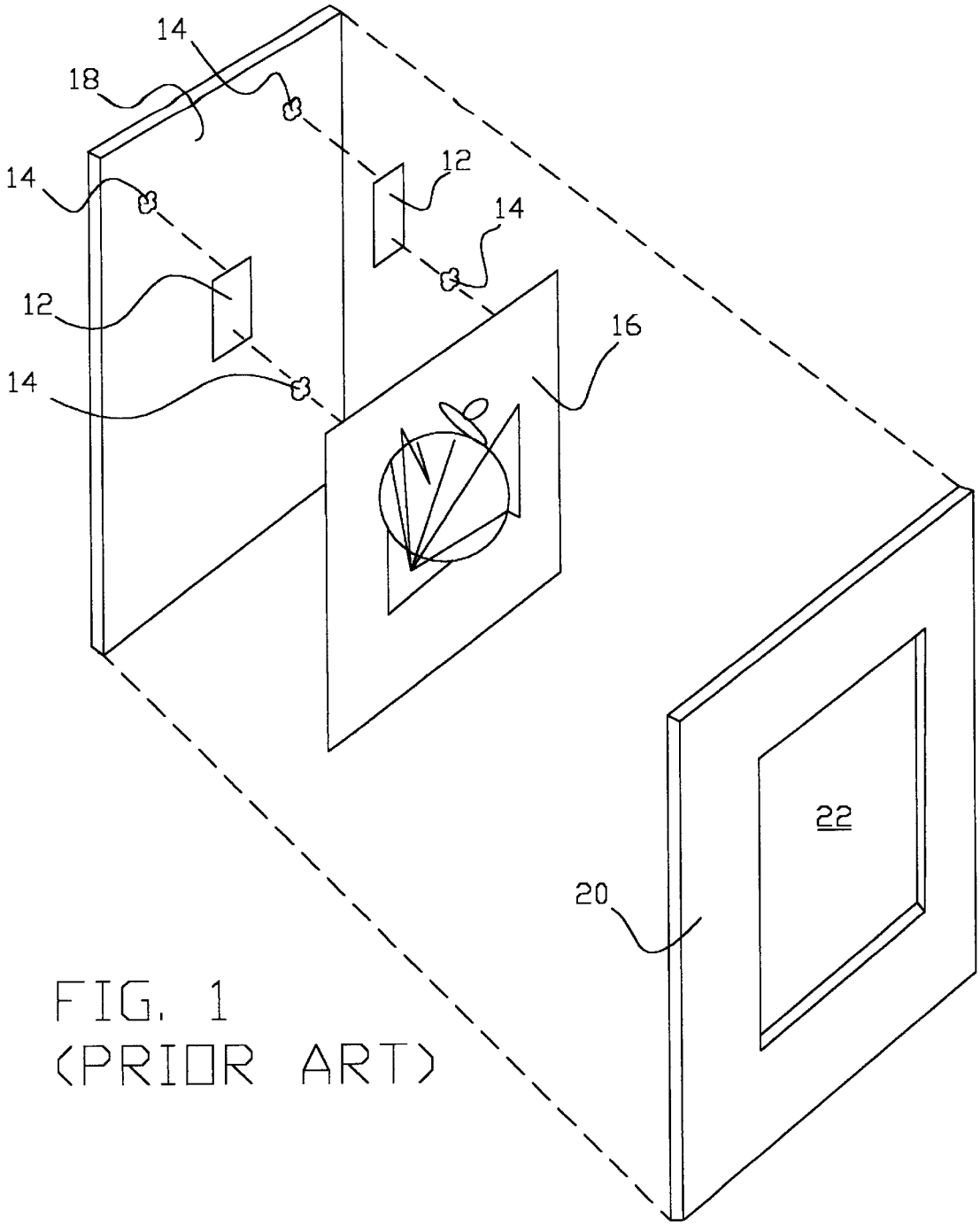
FIG. 1 (PRIOR ART)
FIG. 1 is an exploded perspective view showing the individual components of a typical framed artwork of the prior art.

As was discussed in the BACKGROUND OF THE INVENTION, all of the hinging methods heretofore used in art galleries, museums, and the like employ means for hinging the artwork to a mounting board for vertical display, which means will in time cause degradation of the artwork, the hinge and/or the mounting board. This may or may not be a serious problem, depending on such factors as the value of the artwork, the time contemplated for the mounting arrangement, etc. However, as will be readily understood, it is stressed that masterpieces or documents and the like of irretrievable historical importance need to be hinged in a manner which will not cause any degradation of the hung artwork or document.

Before discussing the present invention, at the risk of redundancy, it is thought appropriate to again review the primary means for hinging artwork used today, essentially as it has been used for centuries.

As has been discussed in the BACKGROUND (reference being made, for example, to the highly respected and authoritative publications from the National Preservation Program of the Library of Congress, the Museum of Fine Arts in Boston, Mass., and the Conservator of Prints and Drawings of the Art Institute of Chicago, the method of choice utilized in museums, art galleries and the like for hinging artwork and other planar articles for display today, as in centuries before, employs paper hinges attached to the artwork and to the mounting board by a wheat or rice starch paste. The application of this wet starch paste disturbs the sizing and fibers of the paper artwork, causing the fibers to swell and revert to their expanded state. Additionally, fiber delamination and permanent and irreversible fiber contamination can occur. This procedure, termed the "conservative" manner of mounting the artwork, can be reversed by applying water to activate the paste, thereby permitting removal. However, the re-application of water further distends the fibers of the artwork, thereby irreversibly continuing the deleterious effects.

Further, the paste particles are a foreign object within the paper fibers that are a potential food source inviting infestation into the art work that can consume portions of the artwork as well as the paste.

Applicant finds the term "conservative" to be misleading, in that it is not a method which "conserves" the integrity of the artwork and prevents degradation inherent in the method of hinging. Other adverse effects to the paper hinge itself can result in the artwork shifting or falling from the board, resulting in irreparable damage to the artwork itself.

While Applicant has not searched to find any authority on how to obviate these problems over a period of time, it is presumed that the framed artwork in museums and the like are periodically removed from the wall, inspected, and the paste and paper hinges removed and replaced.

The present invention is directed to a novel method for magnetically mounting artwork or other planar material to be displayed to a mounting board which, while being elegant and cost-effective, fully obviates the various problems just mentioned and which are discussed in the BACKGROUND OF THE INVENTION.

According to the present invention, use is made of magnetic means to releasably clamp the artwork in order to suspend it from a mounting board. The magnet contacting the artwork is not a material capable of providing any of the above-mentioned problems inherent in the use of a water-based rice or wheat paste and moreover, the artwork is "removably secured" by the magnetic method of the present invention, removal being made simply by manually separating the two superposed magnets to release the artwork.

The invention may best be understood by reference to the following detailed description of the invention taken conjunction with the illustrative drawings.

Figure 2:
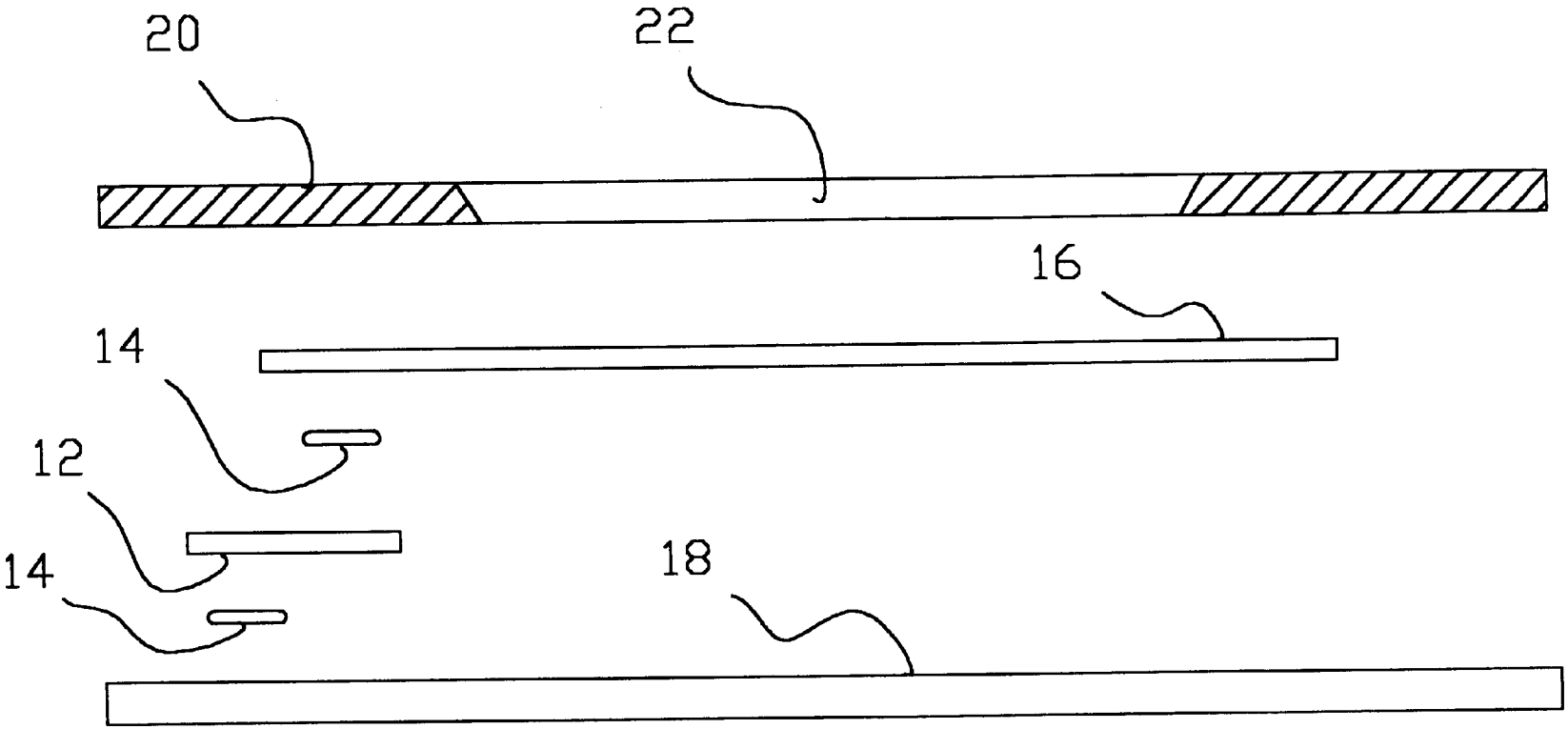
FIG. 2 (PRIOR ART)
FIG. 2 is a schematic side elevation view of the component parts of the framed artwork of FIG. 1.

The state of the art at the time of the present invention is best illustrated in FIGS. 1 and 2.

As shown therein, a pair of hinges 10 are provided comprising an elongated sheet of paper 12 provided with a first adhesive patch 14 adhered to one surface of sheet 12 at one end thereof and a second adhesive patch 14 on the other surface of sheet 12 at the opposed end of the sheet. The hinge is secured to the underside of artwork 16 by the first adhesive patch 14 and then suspended from mounting board 18 by means of the second adhesive patch 14.

A conventional mat 20 having a window 22 is then secured at least one edge thereof to the mounting board (also called the "backboard") to frame the artwork.

The paper for the artwork 16 can comprise many different materials depending at least in part to the period when the artwork was made. Historically, paper in the form we know it today dates back to a Chinese discovery in the first century AD in which the inner bark of the mulberry tree was stripped and the fibers then pounded and matted into a sheet. Later, the Chinese pounded rags and hemp to make paper. The papermaking art evolved over the centuries to include many other materials. The Orientals used vegetable paper, e.g. rice or wheat paper, and the paper-making technology has developed over the years to include many other paper materials, e.g., cotton fibers, linen and cotton rags, wood pulp, and, more recently, synthetic materials.

The hinge paper 12 may, for example, comprise so-called Japanese paper, illustrative examples being mulberry paper, made from kozo fiber from the mulberry plant and sulfite pulp; sekishu kozogami tsura paper (100% kozo); sekishu white; sekishu natural; and kizukishi kozo paper. The length, width, thickness and paper material are selected based on the size, weight and material of the artwork to be hung. While there is some argument to the contrary, it is generally accepted that the hinge should always be weaker than the paper artwork to which it is applied so that under stress the hinge will give way rather than the artwork. In general, the size, weight and condition of the artwork will determine the size, number and weight of the hinges.

As alluded to earlier, the standard paste 14 for binding the artwork 16 to the hinge 12 and to mounting board 18 will be wheat paste or rice paste, and uncooked food grade starch which is cooked in water to a paste consistency. It may also contain a fumigant for preventing infestation and/or a sterilant.

The mounting board 18 and mat 20 will typically be a so-called museum board, a 100% ragboard, acid-free and buffered.

Further details concerning the aforementioned prior art artworks hinged for vertical display as well as their preparation are so well known and reported in the literature that they need not be discussed any further. Likewise, the problems with the prior art procedures are also well documented and have been previously discussed.

Figure 3:
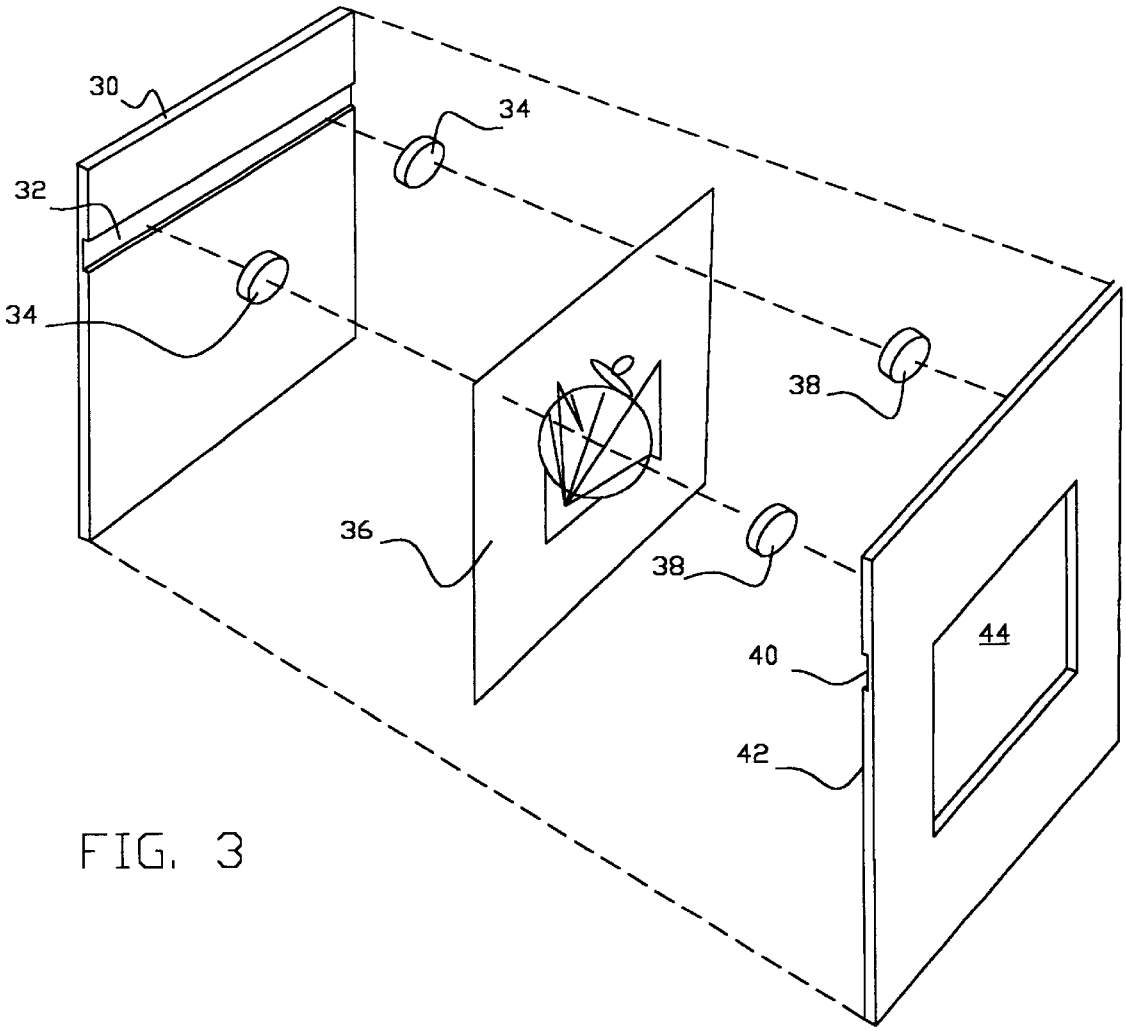
FIG. 3 is an exploded perspective view of the individual essential components of a framed artwork of this invention, namely, reading from left to right, a mounting board, a first pair of magnets, the artwork to be framed, a second pair of magnets aligned in superposition with the first pair of magnets and a framing mat.
Figure 4:
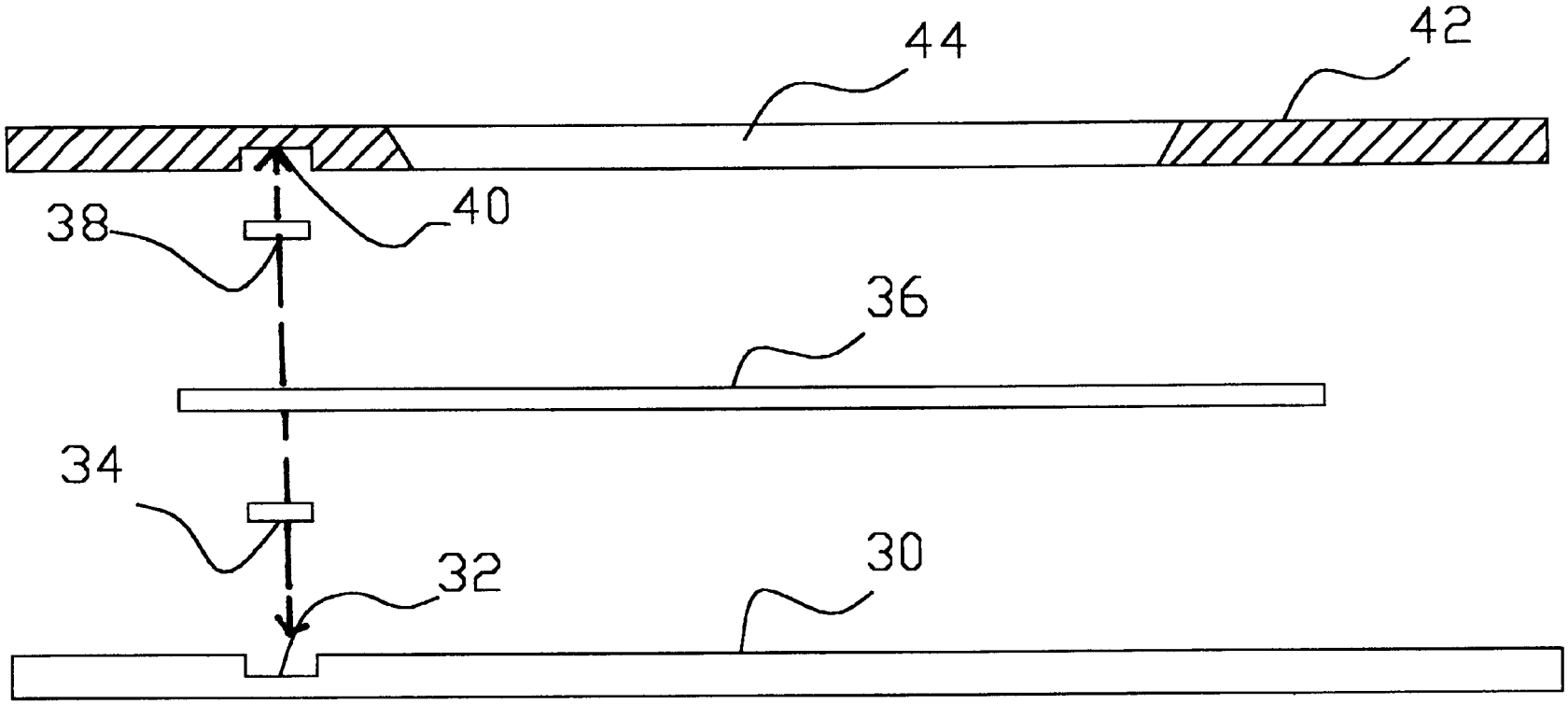
FIG. 4 is an exploded vertical cross-sectional view of the component parts in FIG. 3.
Figure 5:
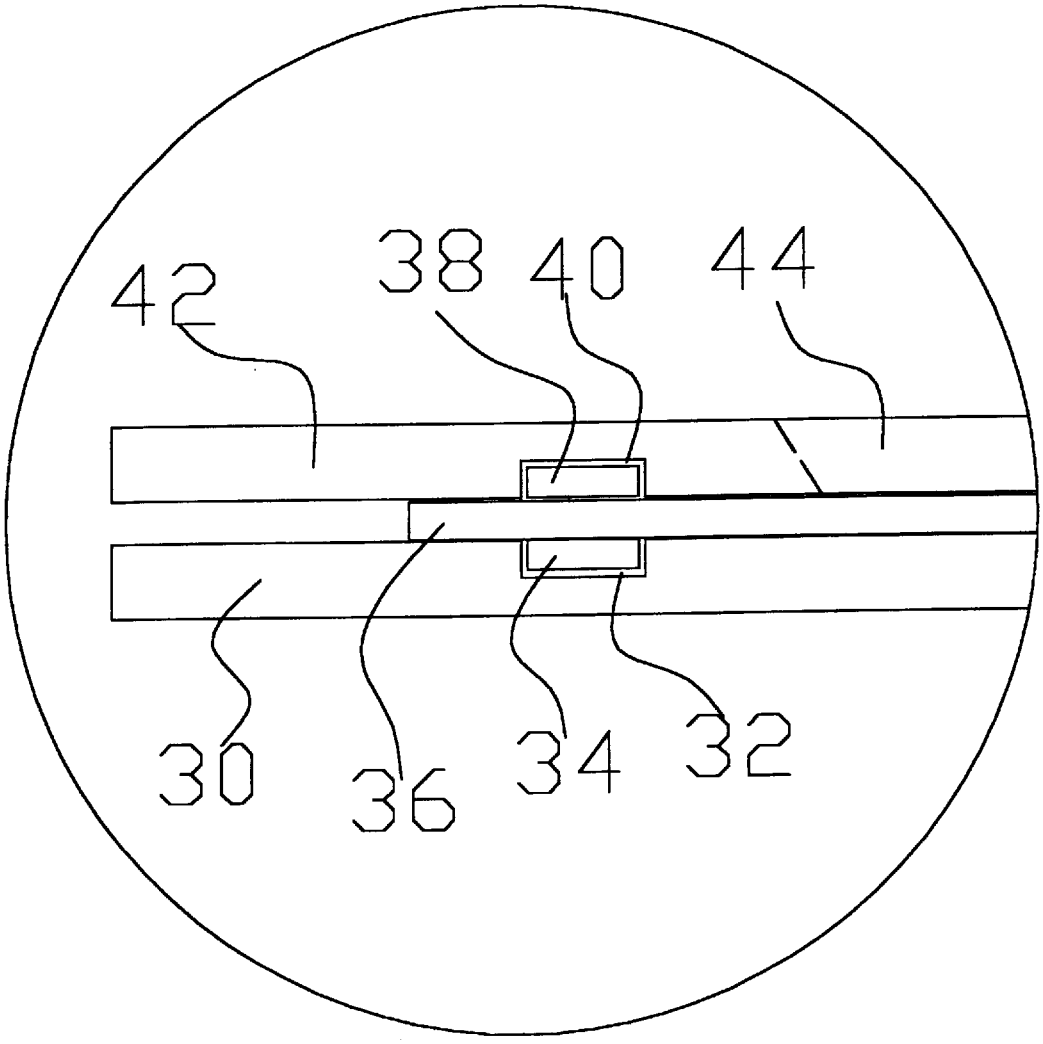
FIG. 5 is a partial plan view (enclosed in a circle) illustrating the framed artwork of FIGS. 3 and 4 mounted for hanging according to the present invention.

The remaining Figures, namely FIGS. 3–5, illustrate the novel system of this invention for mounting priceless planar artwork and the like, which system obviates the problems noted above which have plagued the industry for centuries and still does.

The invention will best be illustrated by reference only to FIG. 3.

As shown therein, the mounting system for displaying artwork 36 consists of mounting board 32; a first pair of magnets 34; a second pair of magnets 38; and a framing mat 42.

Mounting board 32 and mat 42 may per se be known materials and, for example, will typically comprise so-called "museum board", a 100% ragboard, acid-free and buffered.

When placed in superposition, as shown in the drawings, each pair of magnets 34 and 38 will have their opposed surfaces of north and south polarity so as to have a strong attraction to one another.

An important feature of this invention is that each of the four magnets is seated within a recessed area which may take the form of a groove, slot, depression or the like, so that the outer surface of the magnet is substantially flush with the mounting board or mat within which it is seated.

The recessed area 32 of the mounting board 30 and the recessed area 40 of the framing mat 42 are shown for purposes of illustration as being substantially rectangular in configuration extending between opposed side edges of the mounting board and mat, respectively. As illustrated in the drawings, recessed areas 32 and 40 are shown to be of substantially identical shape and proportions. However, the configuration is not critical so long as the dimensions are sufficient to accommodate the magnets to be seated therein.

In fact, in a preferred form, recessed areas 32 and 40 of the mounting board and mat, respectively, will be substantially as shown, namely of substantially the same shape as the magnet to be seated therein but of very slightly larger dimensions so that the magnets can be easily seated therein but not free to roam from their position when seated therein.

It should be noted that since the magnets are not permanently fixed into position relative to their respective slots or grooves, they are free to move relative to the e expansion and contraction of the artwork.

In operation, two of the magnets 34 may first be placed in spaced relationship to one another into recessed area 32 of the mounting board. The artwork 36 is next placed over the magnets 34 so that the image area of the artwork is aligned within the mat window 44. The second set of magnets 38 is then placed over the artwork and into superposition over the first pair of magnets 34. The placement of the second set of magnets 38 is of course readily accomplished as they will magnetically align with the first set of magnets 34. The mat 42 is then placed over the artwork/magnets so that the recessed area 40 of mat 42 aligns to seat the second set of magnets 38 therein, thus completing the assembly.

As alluded to above, the magnetic materials employed are selected to provide a "strong" magnetic field tightly clamping and securing the artwork sandwiched therebetween, thereby releasably securing the artwork or other planar material against accidental movement and thus positioning it for viewing without the need of hinges or other mechanical means. As used herein, the term "strong" cannotes a magnetic field sufficiently strong to retain the artwork when the mounted artwork is placed in a vertical position for viewing, stabilized against slippage or release from the magnetic means due to gravitational force for a predetermined length of time which can, for example, be just short of archival stability.

As one skilled in the art will readily understand, the selection of the magnets will in part depend upon such factors as the size, weight and material of the artwork. In any case, the determination of the strength of the magnet to use will be within the expected judgment of the skilled worker.

By way of illustration, suitable magnetic materials contemplated by this invention include high energy rare earth permanent magnets such as samarium cobalt, neodymium-iron-boron magnets, alnico magnets (the name being derived from their main constituents, aluminum, nickel and cobalt), ceramic magnets sintered from strontium ferrite, and strontium ferrite composites such as PLASTALLOY™, a permanent magnet strip and sheet of rubber bonded strontium ferrite. These magnets possess the requisite stability as well as resistance to demagnetization.

While permanent magnetic materials are preferred, it is also contemplated that, if desired, electro magnets may also be employed.

In any case, in part for aesthetic reasons and in part for the efficiency of securing the artwork, the preferred shape of the magnetic materials is generally disc-shaped, e.g. with a diameter of on the order of a half inch or less and a thickness of on the order of 0.030 to 0.250 inch. However, other shapes are also contemplated. In other words, the magnets contemplated for use in this invention may, for convenience, be of any shape and/or thickness that is commercially available, e.g., circular, rectangular or any other configuration.

As is known, magnetic materials may be oriented so as to have better magnetic properties in a given direction; or they may be non-oriented (isotropic) materials which have equal magnetic properties in all directions. Either is contemplated by this invention.

Preferred are discs, rings and bar-shaped magnets magnetized north on one face and south on the other and which exhibit a coercive force $H_c$ of at least 2100 oersteds and preferably 5000 or more oersteds.

While the use of two opposed magnets is preferred, it, will be appreciated that the use of one magnet and a ferromagnetic material exhibiting a strong reciprocal magnetic attraction for the selected magnet will instead be equally applicable.

As will be readily understood, the invention contemplates the use of at least two sets of opposed magnets, one positioned on each side edge of the article to be displayed. However, if the article is of sufficient size and/or weight that two sets of magnets will be insufficient, obviously additional sets of magnets may be positioned between the side edges of the artwork to be displayed.

To recapitulate, while the invention has been described in detail with reference to hanging artwork for display, it is to be expressly understood that the invention is in fact equally applicable to displaying planar works in general. This would include, for example, priceless documents, maps, etc., particularly such articles of priceless and or great historical value.

This is particularly true because the present invention will provide stability against degradation of the document which is at least just short of archival stability, a critical advantage not obtainable with the mounting techniques of the prior art which have been described earlier in this application and illustrated in FIGS. 1 and 2.

It will be appreciated that various changes may be made without departing from the scope of this invention and, accordingly, the foregoing description and the accompanying drawings shall be taken as illustrative and not in a limiting sense.

What is claimed is:

1. A device for displaying artwork and other planar sheet materials comprising:

(a) a first sheet material having top and bottom edges and opposed lateral edges connecting the top and bottom edges;

(b) the first sheet material having a recessed area along the top edge extending between the opposed lateral edges adapted to seat therein at least two magnetic means in spaced apart relationship;

(c) at least two magnetic means inserted in spaced apart relationship within the recessed area of the first sheet material, not being permanently affixed within the recessed area, the magnetic means are free to slide laterally within the recessed area of the first sheet material between the opposed lateral edges;

(d) a second sheet material having top and bottom edges and opposed lateral edges connecting the top and bottom edges;

(e) the second sheet material also having a recessed area along the top edge of the second sheet material extending between the opposed lateral edges and seated therein at least two additional magnetic means in spaced relationship and which are not permanently affixed within the recessed area of the second sheet material and therefore free to slide laterally within the recessed area of the second sheet material between the opposed lateral edges of the second sheet material, the recessed areas of the first and second sheet materials being aligned such that when the first and second sheet materials are placed into superposition, the respective recessed areas are also substantially in superposition;

(f) the at least two additional magnetic means inserted in spaced apart relationship within the recessed area of the second sheet material such that when the first and second sheet materials are placed in superposition, the magnetic means seated within the recessed area of the second sheet material and the magnetic means seated within the recessed area of the first sheet material may each be moved to place the respective magnetic means in superposition whereby to create a strong magnetic force between each set of superposed magnetic means, the magnetic means seated within the recessed areas of the first and second sheet materials further being characterized as being free to move relative to the expansion and contraction of the planar material since they are not permanently fixed within their respective recessed areas.

2. A device as defined in claim 1 wherein the first sheet material comprises a mounting board for engaging and supporting the non-image bearing surface of the planar sheet material to be displayed for viewing.

3. A device as defined in claim 2 wherein the mounting board comprises museum board.

4. A device as defined in claim 2 wherein the second sheet material comprises a mat adapted to be placed over the image-bearing surface of the planar sheet material to be displayed, the mat having a centrally disposed window through which the image-bearing surface of the planar sheet material is framed for viewing.

5. An article of manufacture comprising in combination, a device as defined in claim 1 and artwork or other planar material to be viewed, wherein the artwork or other planar material to be viewed is positioned against one of the first and second sheet materials such that one edge portion of the planar material to be viewed engages the magnetic means seated within the recessed area of that sheet material; and thereafter the other sheet material having magnetic means seated within the recessed area of that other sheet material is advanced into superposition with the sheet material against which the planar material to be viewed has previously been positioned so that the planar material to be viewed is sandwiched between the first and second sheet materials with the respective magnetic means of the first and second sheet materials also being substantially in superposition, thereby creating a strong magnetic force whereby tightly to secure the planar material to be displayed within the magnetic field so generated by the superposed magnetic means.

6. A device as defined in claim 5 wherein each magnetic means comprises a magnet.

7. A device as defined in claim 6 wherein each magnet is a permanent magnet.

8. A device as defined in claim 6 wherein each magnet is disc-shaped.

9. A device as defined in claim 8 wherein each magnet is selected from the group consisting of samarium cobalt, neodymium-iron-boron, alnico and ceramic magnets.

10. A device as defined in claim 8 wherein each disc-shaped magnet has a thickness of on the order of 0.030 to 0.250 inch.

11. A device as defined in claim 6 wherein the recessed areas of the superposed sheet materials possess a combined thickness such that the magnets contained therebetween are substantially completely seated within the combined space of the superposed recessed areas containing each magnet.

12. A device as defined in claim 5 wherein at least one of the magnetic means comprises a ferro-magnetic material, the remaining magnetic means comprising a magnet.

13. A method for displaying artwork and other planar material for viewing comprising the steps of:

(a) providing a first sheet material having top and bottom edges and opposed lateral edges connecting the top and bottom edges, the first sheet material having a first recessed area extending between opposed edges of the first sheet material;

(b) inserting first magnetic means within the first recessed area, the inserted magnetic means being able to slide laterally within the first recessed area between the opposed edges of the first sheet material;

(c) placing the planar material to be displayed over the first magnetic means;

(d) providing a second sheet material having top and bottom opposed edges and first and second lateral edges connecting the top and bottom edges of the second sheet material, the second sheet material having a second recessed area extending between the opposed edges of the second sheet material;

(e) inserting second magnetic means within the second recessed area of the second sheet material, the inserted second magnetic means being able to slide laterally within the second recessed area between the opposed edges of the second sheet material; and (f) positioning the second sheet material over the planar material to be displayed such that the first and second recessed magnetic means are substantially in superposition whereby to sandwich the planar material to be displayed therebetween, the placement of the second magnetic means being readily accomplished as at least one of the first and second magnetic means will slide within its grooved area to magnetically align the magnetic means, the superposed magnetic means possessing a strong magnetic force releasably securing the planar material against accidental movement and thereby positioning the planar material for visual viewing without the need of hinges or other mechanical means, the first and second magnetic means being characterized as being free to move relative to the expansion and contraction of the planar material since they are not permanently fixed within their respective recessed areas.

14. A method as defined in claim 13 wherein one of the first and second sheet materials is a mounting board for engaging and supporting the non-image-bearing surface of the planar material.

15. A method as defined in claim 14 wherein the other of the first and second sheet materials comprises a mat having a window defined by the edges of the other sheet material; and the planar material to be displayed is aligned within the window area for viewing.

16. A method as defined in claim 13 wherein each of the first and second magnetic means comprises a set of at least two magnets.

17. A method as defined in claim 16 wherein each magnet is a permanent magnet.

18. A method as defined in claim 17 wherein each magnet is disc-shaped.

19. A method as defined in claim 13 wherein the planar material for display is a sheet of artwork.

20. A method as defined in claim 13 wherein the coercive force $H_c$ exerted by the superposed magnetic means gripping the planar material therebetween is of at least 2100 oersteds.

* * * * *